United States Patent [19]

Bouvaist

[11] 4,019,927

[45] Apr. 26, 1977

[54] PRODUCTS FORGED IN ALUMINUM ALLOYS WITH IMPROVED MECHANICAL CHARACTERISTICS AND A METHOD FOR OBTAINING SAME

[75] Inventor: Jean Marie Amédée Bouvaist, Grenoble, France

[73] Assignee: Societe de Vente de l'Aluminium Pechiney, Paris, France

[22] Filed: Dec. 23, 1974

[21] Appl. No.: 535,738

[30] Foreign Application Priority Data

Jan. 7, 1974 France ..... 74.00398

[52] U.S. Cl. ..... 148/11.5 A; 148/12.7 A; 148/32; 148/32.5; 148/159

[51] Int. Cl.[2] ..... C22D 1/04

[58] Field of Search ..... 148/11.5 A, 12.7, 159, 148/32.5, 32

[56] References Cited

UNITED STATES PATENTS

| | | | |
|---|---|---|---|
| 2,249,349 | 7/1941 | Deutsch | 148/32 |
| 3,791,876 | 2/1974 | Kroger | 148/11.5 A |
| 3,791,880 | 2/1974 | Hunsicker et al. | 148/11.5 A |
| 3,826,688 | 7/1974 | Levy | 148/11.5 A |
| 3,847,681 | 11/1974 | Waldman et al. | 148/11.5 A |
| 3,868,250 | 2/1975 | Zimmermann | 148/3 |

*Primary Examiner*—W. Stallard

*Attorney, Agent, or Firm*—McDougall, Hersh & Scott

[57] ABSTRACT

The invention relates to products forged in aluminum based alloys with a very low hydrogen content. These products are endowed with an isotropic structure of equi-axial grains, which furnish mechanical features substantially equal in all directions and they have a particularly low critical hardening speed. They are obtained by heat treatment at a temperature slightly higher than the temperature of the solid state. They allow a substantial lightening of certain parts, particularly in aeronautic constructions and the application of hardening in boiling water or even in air without substantial reduction of the mechanical characteristics.

10 Claims, 11 Drawing Figures

0,1 mm 0,05 mm $10^{-3}$ mm 0,1 mm 0,1 mm 0,05 mm $10^{-3}$ mm

Figure 1A:
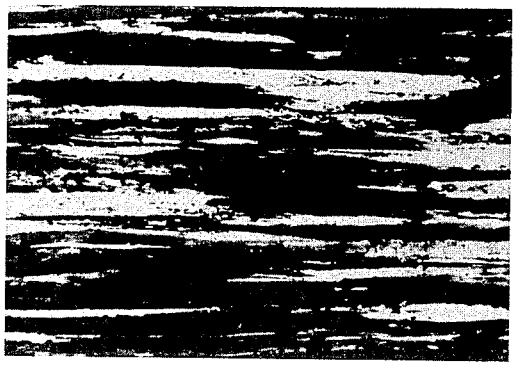

B
A
$H_{V10}$ ($K_G/MM^2$)
190
180
170
160
150
140
130
120
1
5
10
20
30
40
50
100
V(oc/s)

PRODUCTS FORGED IN ALUMINUM ALLOYS WITH IMPROVED MECHANICAL CHARACTERISTICS AND A METHOD FOR OBTAINING SAME

The invention relates to new improved forged products of aluminum alloys, and to a heat treating process of said alloys.

Particularly in aeronautic constructions, increasing quantities are used of aluminum alloy products forged (by rolling, forging, molding, extrusion or other methods). Thus it is standard to fabricate certain cell or wing members, which are exposed to high mechanical stress, by machining from panels whose initial thickness may be as high as 90 to 100 mm, sometimes even more.

It is a known fact that aluminum alloy products are almost always anisotropic and present a fibering arrangement which is introduced by forging. The mechanical characteristics across the fibering thus are clearly inferior to the mechanical characteristics in length, that is in the principal direction of the deformation.

The principal inconvenience of the "fibering" and of the anisotropy which is associated with it is that it is necessary to take into consideration the reduction of the characteristics in the transverse direction, which in many cases leads to a considerable increase in weight of said parts with the troublesome consequences which are known concerning the maximum useful load of aircraft.

The present invention relates to forged products in aluminum alloys, characterized by the fact that their structure is practically homogeneous and isotropical and that their mechanical properties (elastic limit, break load, elongation, propagation energy of shrinkage cracks) are substantially the same in all directions. It relates more specifically to forged products in aluminum alloys like those of the series called "A-ZG" or "A-ZGU" or "A-U" according to the French standards AFNOR A-02.001 and A-02.002, or series "7,000" and "2,000" according to the American A.A. standards (Aluminum Association).

The invention also relates to a new heat treatment which, applied to fibrous forged products obtained by the conventional forging methods, makes it possible to attain, or better eliminate, the anisotropy of the mechanical characteristics.

It has been found, however, that in quite a surprising manner, this new heat treatment had, on these same alloys, an unexpected effect, which is the considerable reduction of the "critical hardening speed". Indeed, it is known that the cooling speed of an alloy during hardening depends both on the dimensions of the part and the nature and the temperature of the hardening fluid. It is known that the cooling speed must be sufficiently high to avoid a reprecipitation of the alloy elements placed in solution.

For each type of alloy, a critical hardening speed is defined, which is for example about 40° C/second for alloy AZ5GU (French standard A 02.001) or 7075 (according to A.A.). For lower cooling speeds, the mechanical characteristics of the alloy (Vickers hardness, break load) drop rapidly, while they remain substantially constant or increase only slightly for higher speeds.

The combination of these two effects — suppression of the anisotropy and reduction of the critical hardening speed — allows for a more rational design of the parts, as they can support substantially identical mechanical stress rates in all directions, and massive parts can be hardened in less energetic media than cold water (for example boiling water or pulsated air) so that the danger of hardening shrinkages and the need of shrinkage annealing will be eliminated.

The new heat treatment, the subject of the present application, is based on the surprising results of a thorough analysis of the "burning" phenomenon.

In the present art, the heat treatments of aluminum alloys are carried out at a temperature which does not exceed a certain, so-called burning temperature, above which there will be a tendency, under the most unfavorable case, toward total disaggregation of the part during the cooling, and in all cases there will be a tendency toward collapse of the mechanical characteristics. The so-called burned structure is characterized by the presence of an irreversible porosity and of liquid phases.

Applicant has discovered that, contrary to the present art, it is possible to carry an aluminum alloy part, without degrading it, above the solidus temperature $T_1$ while still staying below the liquidus temperature $T_2$, providing that, at the moment of the treatment, the hydrogen content of the parts which is likely to be released in gaseous form up to temperature $T_2$ is below 0.5 ppm, and preferably below 0.2 ppm and even 0.1 ppm. This can be obtained by prior degasification treatments in liquid or solid state or by any other means making it possible to extract the hydrogen and to prevent its introduction into the metal before and during the treatment, or any other means likely to fix it in the metal in stable form.

Such a treatment makes it possible to eliminate the "fibering" almost completely.

By suitably selecting for each type of alloy the temperature of treatment $T_t$ ($T_1 < T_t < T_2$) and the holding time at this temperature, it is possible to obtain all the intermediate states between a fibered structure and a recrystallized structure with equi-axial grains.

This treatment is particularly effective on alloys containing secondary phases on the basis of such elements as manganese and/or chromium and/or zirconium and/or iron, which, by the way, are known to have an important inhibiting effect on the phenomena of recrystallization when they are precipitated in a very fine form.

The new treatment, under which the metal is partly returned in liquid phase, makes it possible to cause the precipitates of secondary phases to increase and this makes possible recrystallization without eliminating the hardening effect due to their dispersion. The aspect and the dimensions of the coalescent precipitates are characteristic of the treatment, as shown below, by means of micrographic cuts. Since, moreover, these coalesced precipitates serve as nuclei in the precipitation of rough phases such as $x$ Mg $Zn_2$ during the cooling caused by the hardening, it is understood that the number of the coalesced precipitates decreases as their dimension increases, so that the possibility of hardening the alloy is improved and the critical hardening speed drops below its usual values, as examples 3 and 4 will show.

Among the high resistance alloys for which this treatment is particularly efficacious, one can cite A-U4SG (Cu 4.4% — Si 0.9% — Mg 0.5% — Mn 0.6%), 7075: Zn 5.6% — Mg 2.5% — Cu 1.5% — Cr 0.30% — Mn <9.3%, or its French equivalent, A-Z5GU, and alloys which perform still better, like A-Z6G202, or A-Z9G3U. (7001 according to A.A.)

The treatment according to the invention is followed by a solution treatment at a temperature below $T_1$, in order to resorb the heterogeneities due to the handling between temperatures $T_1$ and $T_2$.

EXAMPLE 1

On a panel 40 mm thick of "7075" alloy (A.S.T.M. standard) having the chemical composition indicated above, the following characteristics were discovered, in condition T6 (solution heat treated 3 hours at 470° C, quenching in cold water and annealing for 24 hours at 120° C):

| Direction of sampling | $LE_{hb}$ | $R_{hb}$ | A% | $K_{1c}$ |
|---|---|---|---|---|
| Length | 52.4 | 59.1 | 14.4 | 127 |
| Short transverse | 52.7 | 56.8 | 3.3 | 68 |

This same panel, whose temperature $T_1$ in solid condition was found in the vicinity of 535° C, was maintained for 1 hour and 30 minutes at 540° C (5° C above $T_1$), then for 3 hours at 470° C (65° C below $T_1$), then hardened in cold water and subjected to a 24 hour annealing at 120° C.

Then the following characteristics were discovered:

| Direction of sampling | $LE_{hb}$ | $R_{hb}$ | A% | $K_{1c}$ |
|---|---|---|---|---|
| Length | 52.0 | 57.3 | 16.0 | 108 |
| Short Width | 52.4 | 57.4 | 17.0 | 88 |

The critical value of the factor of "stress intensity" $K_{1c}$ (tenacity) is, in both cases expressed in hectobars $x\sqrt{mm}$. It is noted that in this case an almost perfect isotropy of the mechanical characteristics is obtained and that the anisotropy of tenacity is reduced very noticeably. The tenacity in the direction of the short width increased by about 0%.

EXAMPLE 2

A panel 50 mm thick in A-U4SG was taken, which has the following chemical composition: Cu 4.3% — Si 0.85% — Mg 0.45% — Mn 0.58% — Fe 0.18%. For this composition the temperature $T_1$ is approximately 525° C. After hot rolling and the usual treatment in state $T_6$ (placing in solution for 8 hours at 175° C), the following mechanical characteristics are obtained:

| Direction of sampling | $LE_{hb}$ | $R_{hb}$ | A% |
|---|---|---|---|
| L (length direction or rolling) | 46.0 | 51.1 | 12.0 |
| TL (Long transverse) | 43.5 | 49.0 | 9.0 |
| TC (short transverse, in thickness) | 41.8 | 47.5 | 5.2 |

This panel was subjected to a heat treatment according to the invention which consisted of:

4 hours holding at 535° C (that is 10° above $T_1$)

8 hours maintaining in solution at 505° C (that is 20° below $T_1$) hardening in cold water 8 hours annealing at 175° C Then the following mechanical characteristics were obtained:

| Direction of sampling | $LE_{hb}$ | $R_{hb}$ | A% |
|---|---|---|---|
| L (length) | 45.9 | 50.2 | 9.3 |
| TL (long width) | 46.0 | 50.5 | 7.5 |
| TC (short width) | 46.1 | 51.0 | 6.0 |

It is noted that the limit of elasticity and the break load are substantially equal in the three directions and that these "short width" characteristics rose to the highest level found on the panel treated normally.

The micrographic examination of the parts defibered according to the invention shows a characteristic fine grain recrystallized structure with equi-axial grains and it contains numerous precipitates of secondary phases in a size larger than 0.5 microns, while the parts treated in the traditional manner and fibered have a dispersion of these phases which is much finer, their average size being then between 0.05 and 0.1 microns. (It is important to point out that the "average size" of these precipitates corresponds to the average size of the largest particles which represent about 70 to 80% of the volumic fraction of said secondary phases).

Figure 1B:
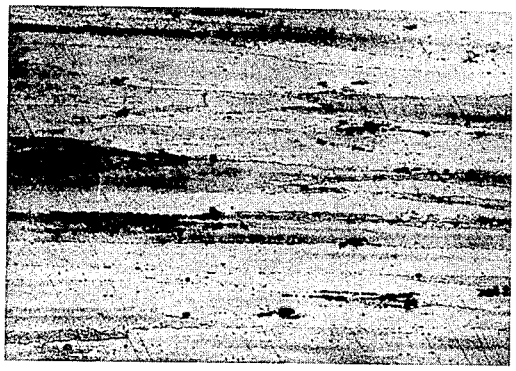
Figure 1C:
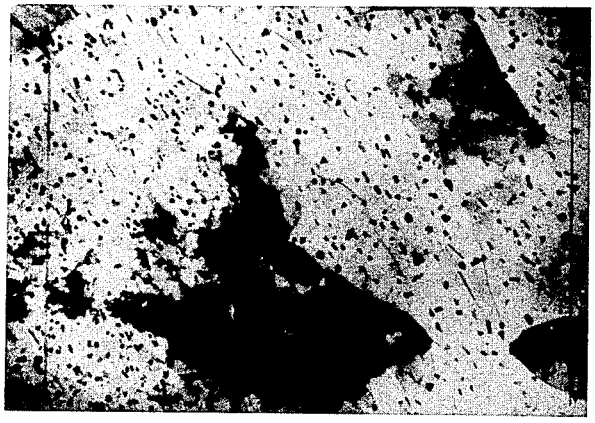
Figure 2A:
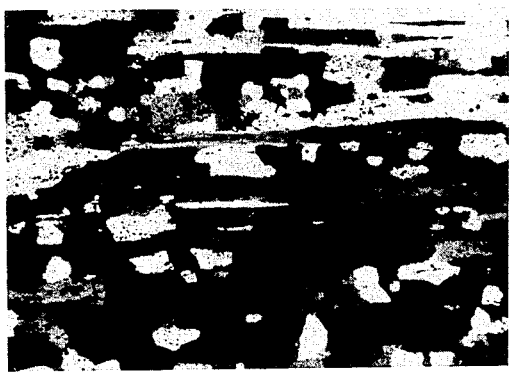
Figure 3A:
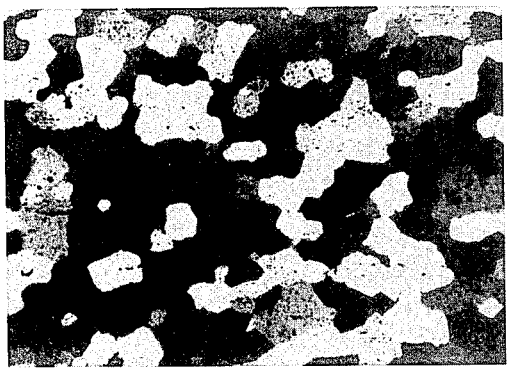
Figure 3B:
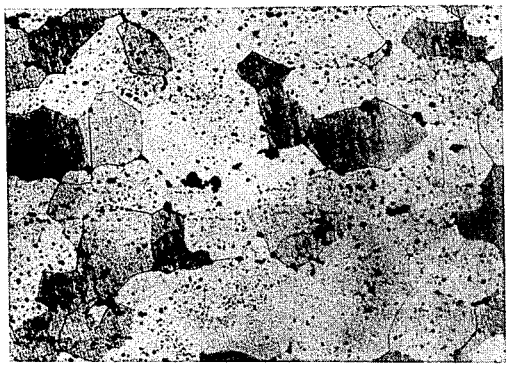
Figure 3C:
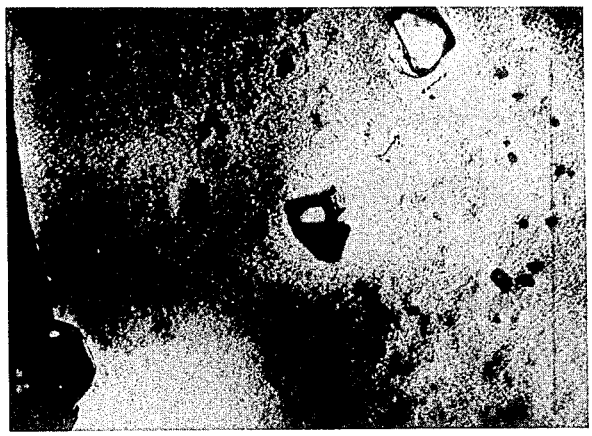

FIGS. 1*a*, 2*a*, 3*a* correspond to samples attacked by the fluoboric reagent prior to examination under the optical microscope;

FIGS. 1*b* and 3*b* correspond to samples attacked by the Keller reagent prior to examination under the optical microscope;

FIGS. 1*c* and 3*c* correspond to the examination by transmission under the electronic microscopy.

The respective scales are indicated besides each figure.

The micrographic cuts 1*a*, 1*b*, 1*c* show the appearance of the structure of a part in 7075 alloy, treated in the conventional manner for 3 hours at 470° C while cuts 2 and 3 show the aspect of the structure of the same piece treated according to the invention ($t_t > T_1$). For this alloy $T_1$ =535° C.

Cut 1A shows that the structure is fibrous and that the secondary phases (with Cr and Fe), precipitated very finely inside the grains, are invisible under optical microscopy (1*b*) and are only visible under electron microscopy (1*c*).

For a short time above temperature $T_1$ (1 hour at 540° C followed by 3 hours at 470° C), it is shown that the defibering is partial (2*a*): recrystallization is produced in the zones where the precipitation of the zones secondary to Cr and Fe has coalesced into a dispersion of globules which then are visible under optical microscopy.

For longer times at temperature $T_t$ (4 hours at 540° C followed by 3 hours at 470° C), the defibering is total (3*a*): the secondary phases are there too, clearly visible under optical microscopy (3*b*).

The rate of defibering thus depends on the holding time above temperature $T_1$ defined above and the spread between the treatment temperature $T_t$ and $T_1$. The structure obtained is typical of the treatment.

It is very different from that of a fibered metal, but also from that which is observed on a metal recrystallized after an annealing treatment in solid state. In this latter case, the precipitation of the secondary phases is very fine and homogeneous inside the grains.

The reduction of the critical hardening speed, by treatment according to the invention, is evidenced by the figures and examples that follow.

Figure 4:
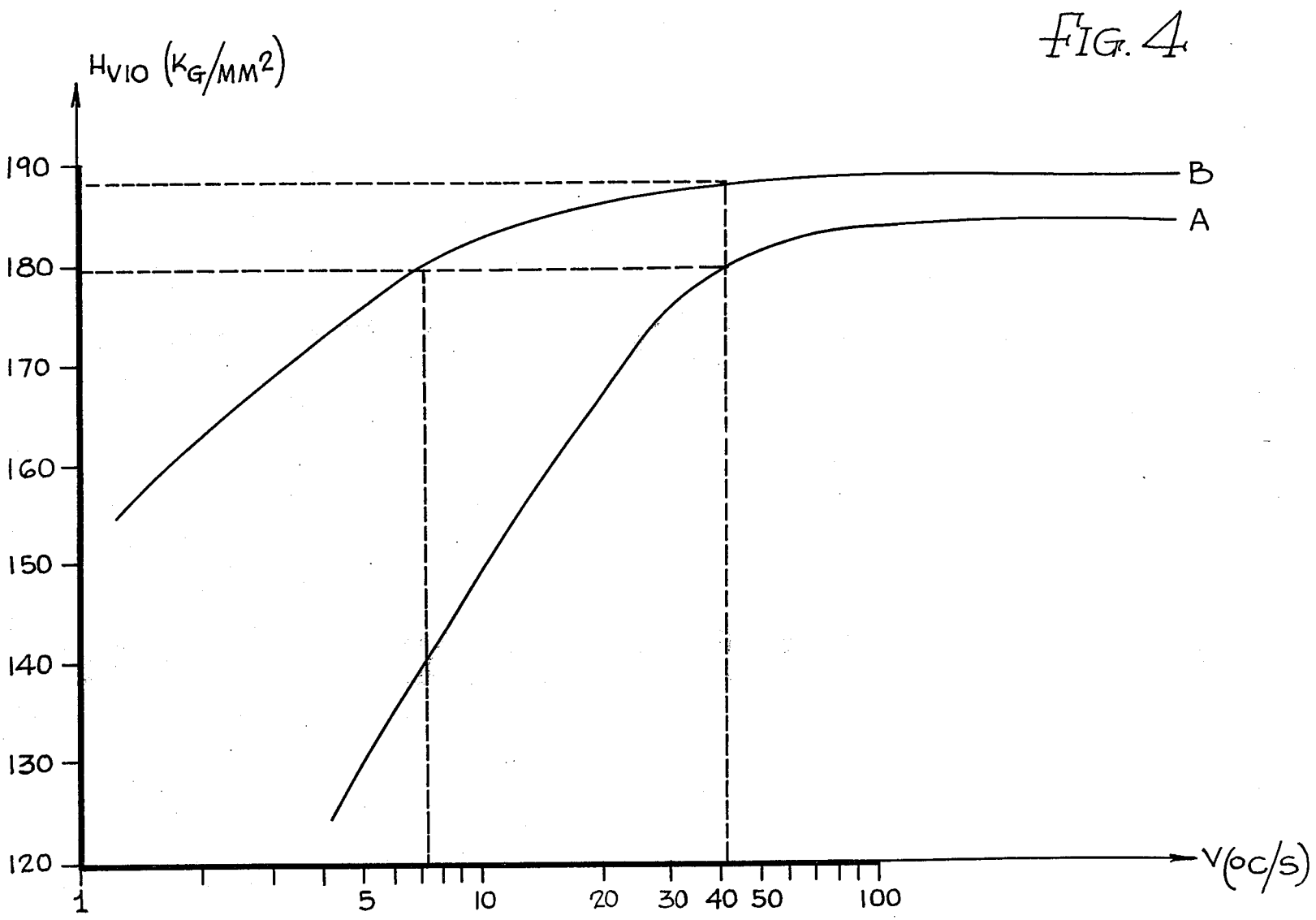
Figure 5:
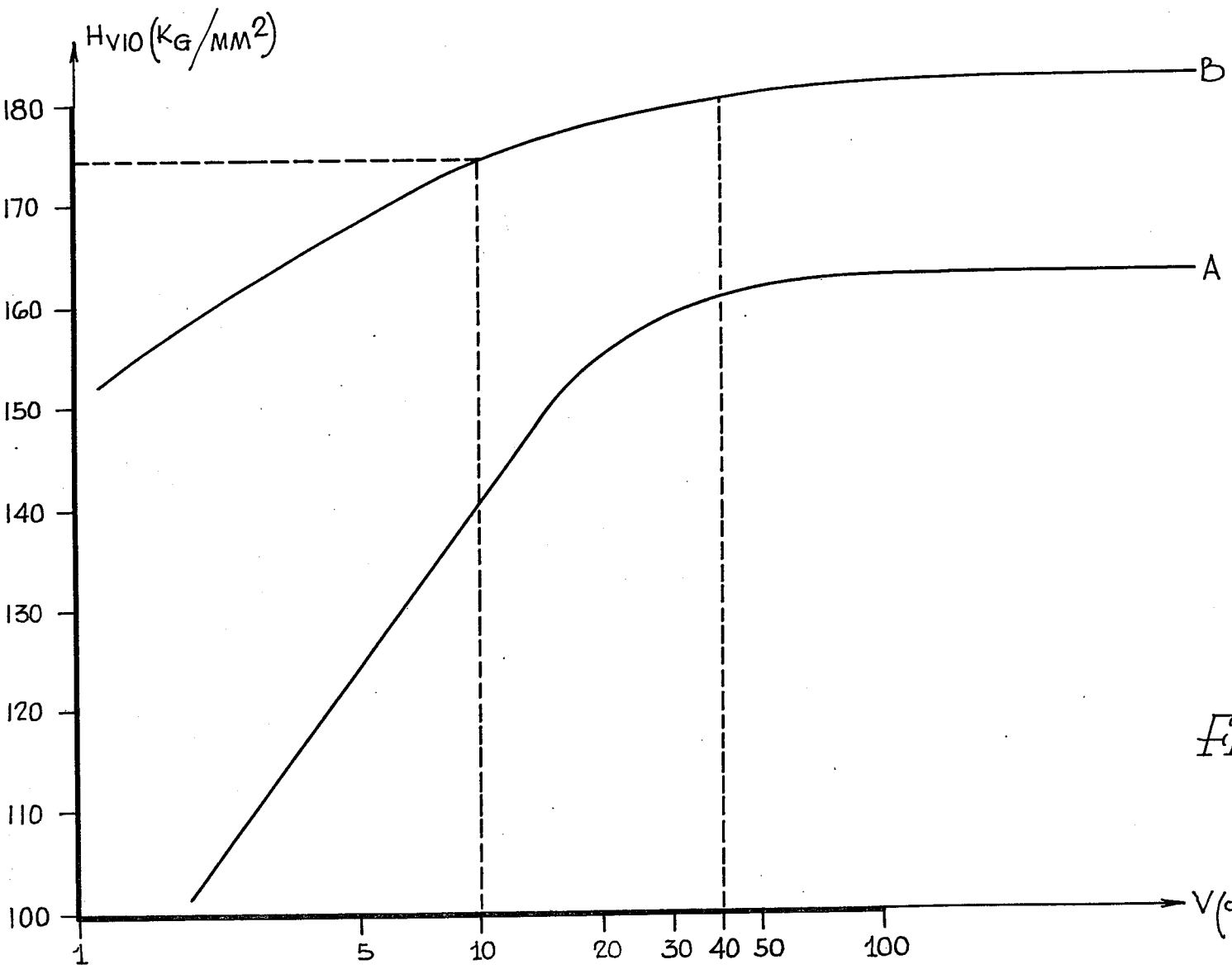

FIGS. 4 and 5 shown how the vickers hardness of alloy 7075 builds up ($H_v$ 10 in kg/mm²) in function of the hardening speed (in °C per second), for a 7075 treated conventionally (curves A) and according to the invention (curves B). The critical hardening speed, which is on the order of 40° C per second in the first case, is reduced to the vicinity of 10° C in the second case.

In the case of FIG. 1, the annealing was 24 hours at 120° C (treatment T6) and in the case of FIG. 2, 6 hours at 105° C, then 24 hours at 158° C (treatment T 73).

It is also noted that treatment T 73 gives alloy 7075 an increase of hardness which is clearly higher (by about 20 kg/mm²) than that given by treatment T6 for the same hardening speed.

Figure 6:
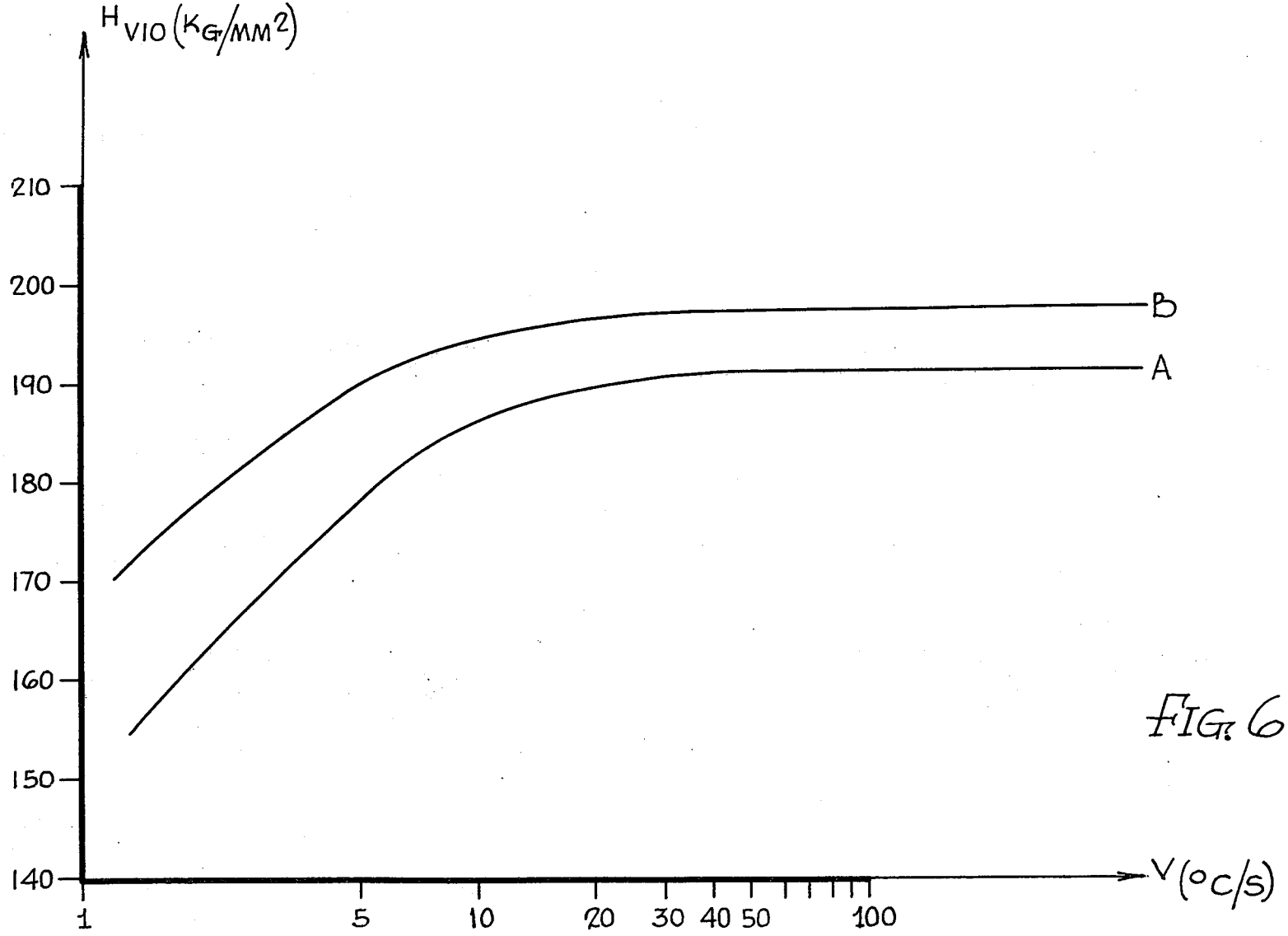
Figure 7:
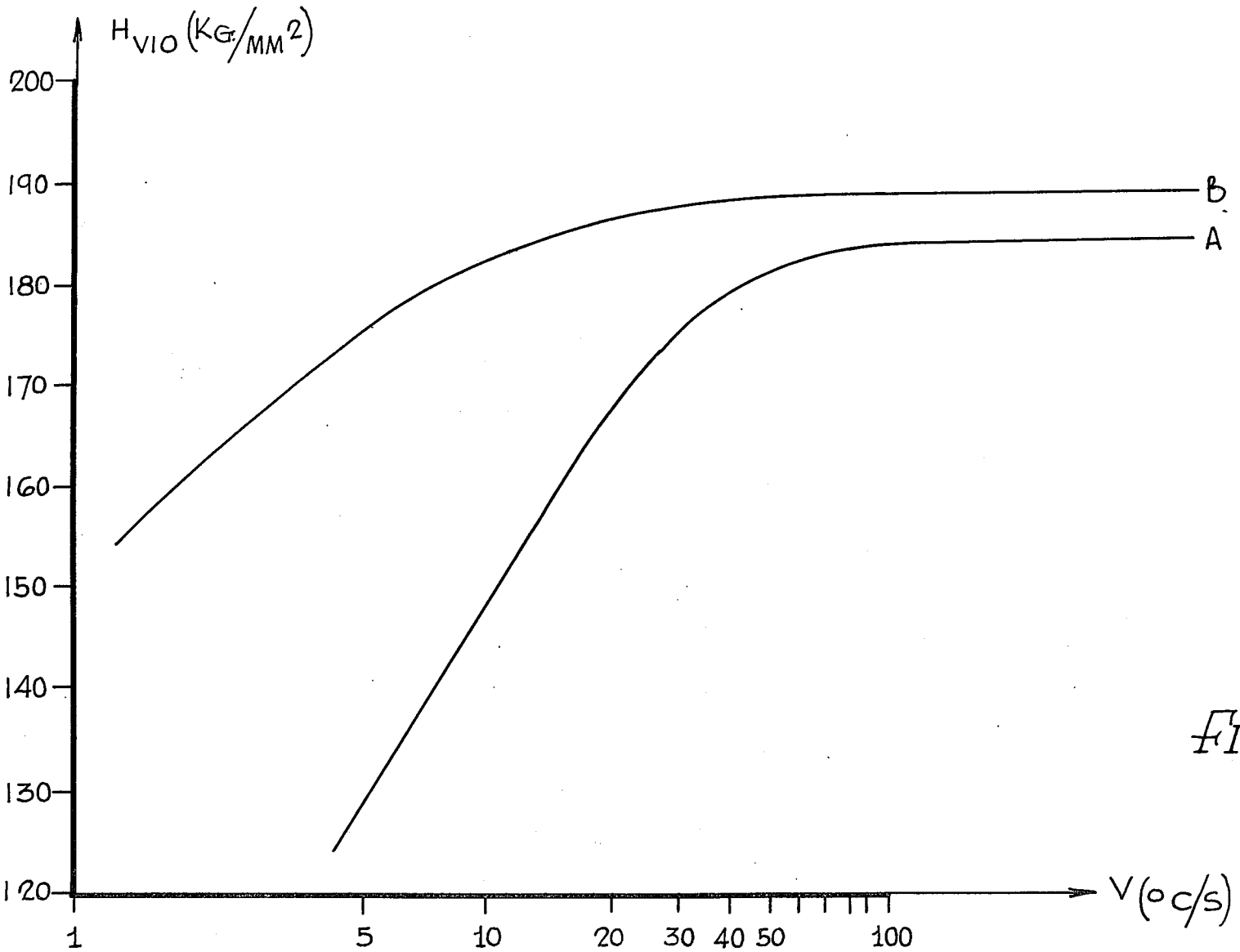

FIGS. 6 and 7 show the Vickers hardness of alloy 7075 (AZ6GU with 0.10% Zr) builds up as a function of the hardening speed (in °C per second) for a conventional treatment (curves A) and according to the invention (curves B), the annealing was 24 hours at 120° C in case of FIG. 3 (treatment T6) and 24 hours at 120° C, then 24 hours at 163° C (treatment T 73) in the case of FIG. 4.

The improvement furnished by the treatment according to the invention is still very important. For example, in the case of the massive forged parts in alloy 7050, it permits use of natural cooling in calm air (corresponding to a cooling speed on the order of 0.5° C per second), without any notable loss of mechanical characteristics in relation to a part hardened in water, yet avoiding all the inconveniences of water hardening (dangers of hardening cracks, necessity of effecting a relaxation annealing).

The reduction of the critical hardening speed offers several important applications, particularly:

1. It makes it possible to increase the thickness of the hardened parts, with the mechanical internal features being equal.

2. It makes it possible to use less energetic hardening media than cold water, for example: boiling water, and to reduce the residual hardening stresses, so that the relaxation operations on rolled products can be eliminated.

EXAMPLE 3

The Vickers hardness was measured on alloy test pieces 7075, treated in the conventional manner (3 hours at 470° C, quenching in water, aging T6) and according to the invention (4 hours at 540° C, then 3 hours at 470° C, quenching in water, annealing T6 as above, for a water temperature of 20° and 100° C.

The following results were obtained:

| | HARDENING IN WATER | VICKERS HARDNESS (kg/mm²) |
|---|---|---|
| Convention treatment and annealing T6. | - at 20° C | 185 |
| | - at 100° C | 123 |
| | - Reduction of hardness | 62 |
| Treatment according to the invention and annealing T6 | - at 20° C | 180 |
| | - at 100° C | 184 |
| | - Reduction of hardness | 6 |

It is noted that hardening in boiling water reduces the Vickers hardness by approximately 30% in the case of a conventional treatment and barely by 3% in the case of a treatment according to the invention.

EXAMPLE 4

The mechanical features were measured on test pieces sampled in the direction of thickness (short width) of a 50 mm 7075 alloy panel treated conventionally; solution heating 2 hours at 470° C, quenching in cold water at 20° C in one case, hardening in boiling water in a second case, cold working of 2% by traction and aging of 24 hours at 120° C in one case (condition called: T 651) and 8 hours at 105° C, then 24 hours at 158° C in a second case (state T 7351) and treated according to the invention; 4 hours at 540° C, then 2 hours at 470° C (fusion temperature of the eutectics having been found equal to 478° C, and that of solid parts of equilibrium at 532° C), hardening in cold water at 20° C in one case, hardening in boiling water in a second case, cold hammering of 2% by traction and annealing for 24 hours at 120° C in a second case (state T651) and 8 hours at 105° C, then 24 hours at 165° C in a second case (state 7351).

Then the following characteristics are obtained in the short width direction:

| | HARDENING IN WATER AT | | STATE T 651 | STATE T 7351 |
|---|---|---|---|---|
| Conventional Treatment | 20° C | R | 54.8 | 48.2 nb |
| | | LE | 47.5 | 40.1 nb |
| | | A% | 4% | 5% |
| | 100° C | R | 47.1 | 40.4 nb |
| | | LE | 38.5 | 30.5 nb |
| | | A% | 5.2 | 3.5% |
| Treatment according to the invention | 20° C | R | 56.7 | 50.9 nb |
| | | LE | 48.4 | 42.4 nb |
| | | A% | 8.7 | 6.2% |
| | 100° C | R | 55.5 | 48.3 nb |
| | | LE | 47.6 | 41.5 nb |
| | | A% | 6.5 | 6.1% |

It has been noted that the hardening in boiling water on the conventional treatment causes the mechanical features to drop from 10 to 20% and barely by 2% on treatment according to the invention.

3° — The reduction of the critical hardening speed is accompanied, also, as shown in FIG. 4 to 7, by a much slower reduction of the hardness (and, correlatively, of the other mechanical characteristics) when said speed is below the critical speed. As a borderline case, one may envisage air hardening (speed about 1° C/second is pulsated air and about 0.5° C in calm air) without notable loss of mechanical characteristics.

EXAMPLE 5

The mechanical characteristics were measured in the short width direction of test pieces in alloy 7075, treated in the conventional manner and according to the invention, and in both cases hardened in calm air, then annealed 24 hours at 120° C. The following has been found:

| | R (hb) | LE(hb) | A% |
|---|---|---|---|
| Conventional treatment | 34.2 | 21.2 | 7.2 |
| Treatment according to the invention(4 hours at 540° C) | 48.5 | 43.0 | 2.4 |

I claim:

1. A method for improving the isotropic structure and lowering the critical quenching rate of wrought products of aluminum alloy by reducing the hydrogen content of the alloy to below 0.1 ppm, maintaining the product for from ½ to 12 hours at a temperature $T_t$ above the solidus temperature $T_1$ but below the liquidus temperature $T_2$ while keeping the hydrogen content of the alloy below 0.1 ppm and then heat treating the product at a temperature below $T_1$ to resorb heterogeneities formed during the preceding heat treatment between $T_1$ and $T_2$ and quenching the heat treated product.

2. A method as claimed in claim 1 which includes the step of quenching the heat treated product in hot water.

3. A method as claimed in claim 1 which includes the step of quenching the heat treated product in air.

4. A method as claimed in claim 1 which includes the step of cold working the wrought product.

5. A method as claimed in claim 1 which includes the step of aging the wrought product.

6. A wrought aluminum alloy produced by the method of claim 1.

7. Wrought products of aluminum alloys as claimed in claim 6 containing at least one alloying element selected from the group consisting of Cu, Mg, Si and Zn, and one or more additional elements or impurities which furnish secondary phases selected from the group consisting of Mn, Cr, Zn and Fe, characterized (1) by an isotropic structure with equiaxial grains which furnish mechanical properties that are substantially identical in all directions, (2) by a low critical quenching rate, (3) by the fact that a considerable proportion of the usual precipitates of the secondary phases are coalescent with a size above 0.5 microns, and (4) by a hydrogen content, capable of being released in gaseous form up the liquidus temperature, below 0.5 ppm.

8. Wrought products of aluminum alloys as claimed in claim 6 containing at least one element selected from the group consisting of Cu, Mg, Si, Zn, and one or more additional elements or impurities which furnish secondary phases selected from the group consisting of Mn, Cr, Zn and Fe, characterized (1) by a low quenching rate, (2) by a mixed structure containing on the one hand equiaxial grain areas in which the usual precipitate of the secondary phases are coalescent in a large proportion with a size above 0.5 microns and, on the other hand, fibered grain areas, (3) by improved mechanical properties in the direction perpendicular to the principal direction of deformation, and (4) by a hydrogen content, capable of being released in gaseous form up to the liquidus temperature, below 0.5 ppm.

9. Wrought products as claimed in claim 6 having high mechanical properties and low critical quenching rate in aluminum alloy pertaining to the series selected from the group consisting of A-ZG, A-ZGU, A-U according to the French standard Afnor A 02001 and A 02002, and the series 7000 and 2000 according to ASTM standards characterized by the structure as claimed in claim 5.

10. Wrought products having high mechanical properties and low critical quenching rate in aluminum alloy as claimed in claim 6 pertaining to the series selected from the group consisting of A-ZG, A-ZGU, A-U according to the French standard Afnor A 02001 and A 02002, and the series 7000 and 2000 according to ASTM standards characterized by the structure as claimed in claim 7.

* * * * *

UNITED STATES PATENT OFFICE

CERTIFICATE OF CORRECTION

Patent No. 4,019,927 Dated April 26, 1977

Inventor(s) Jean Marie Amedee Bouvaist

It is certified that error appears in the above-identified patent and that said Letters Patent are hereby corrected as shown below:

Column 3, line 1, change "<9.3%" to -- <0.3% --.

Column 3, line 43, change "0%" to -- 30% --.

Column 5, line 18, change "7075" to -- 7050 --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*